US006817344B2

(12) United States Patent
Dandan et al.

(10) Patent No.: US 6,817,344 B2
(45) Date of Patent: Nov. 16, 2004

(54) FUEL SUPPLY SYSTEM

(75) Inventors: Issac R. Dandan, Kenosha, WI (US); Amy Marie Hess, Metamora, IL (US); Bryan E. Nelson, Lacon, IL (US)

(73) Assignee: Caterpillar Inc, Peoria, IL (US)

( * ) Notice: Subject to any disclaimer, the term of this patent is extended or adjusted under 35 U.S.C. 154(b) by 37 days.

(21) Appl. No.: 10/330,496

(22) Filed: Dec. 30, 2002

(65) Prior Publication Data

US 2004/0123842 A1 Jul. 1, 2004

(51) Int. Cl.[7] ..... F02M 37/04
(52) U.S. Cl. ..... 123/514; 123/459; 123/510
(58) Field of Search ..... 123/456, 457, 123/459, 510, 514

(56) References Cited

U.S. PATENT DOCUMENTS 3,741,182 A * 6/1973 Wade et al. ..... 123/459
5,558,068 A * 9/1996 Kunishima et al. ..... 123/516
5,626,114 A * 5/1997 Kushida et al. ..... 123/198 D
5,762,047 A * 6/1998 Yoshioka et al. ..... 123/509
6,024,064 A * 2/2000 Kato et al. ..... 123/179.17
6,102,004 A 8/2000 Cowden et al. ..... 123/446
6,223,725 B1 * 5/2001 Onishi et al. ..... 123/447
6,253,740 B1 * 7/2001 Rembold ..... 123/509
6,422,213 B2 * 7/2002 Rumpf et al. ..... 123/510
6,578,553 B1 * 6/2003 Schubert et al. ..... 123/458

FOREIGN PATENT DOCUMENTS

WO WO 00/61933 * 10/2000

* cited by examiner

*Primary Examiner*—Weilun Lo
(74) *Attorney, Agent, or Firm*—Alan J Hickman

(57) ABSTRACT

A fuel supply system for an internal combustion engine is provided. The system includes a first pump adapted to generate a flow of fuel and a second pump in fluid connection with the first pump and adapted to increase the flow of fuel to a predetermined pressure. A fuel filter is disposed between the first pump and the second pump. A sensing line is adapted to provide an indication of the pressure of the flow of fuel between the filter and the second pump. A pressure regulator is adapted to receive the indication of the pressure of the flow of fuel and to control the flow of fuel delivered to the fuel filter based on the indication of the pressure.

19 Claims, 4 Drawing Sheets

FUEL SUPPLY SYSTEM

TECHNICAL FIELD

The present disclosure is directed to a fuel supply system and, more particularly, to a fuel supply system for an internal combustion engine.

BACKGROUND

An internal combustion engine operates when a fuel, such as, for example, diesel, gasoline, or natural gas, is combusted in a series of combustion chambers. The internal combustion engine typically includes a fuel supply system that delivers the fuel to each of the combustion chambers. A fuel supply system for an internal combustion engine typically include a series of fuel injectors that inject a certain quantity of fuel into each combustion chamber. The injected fuel mixes with intake air in the combustion chamber to form a combustible mixture.

The combustible mixture is then ignited through, for example, a spark or by compression. The subsequent combustion of the fuel and air mixture drives a piston associated with the combustion chamber through a reciprocal motion in a cylinder. The driving motion of the piston is translated into a rotation of a crankshaft, which may be used, for example, to operate a power generator or to power a vehicle.

The performance of the engine may be improved by optimizing the combustion conditions of the fuel and air mixture in the combustion chamber. For example, improving the mixing characteristics, or distribution, of the fuel and air mixture may improve the combustion process. A combustible mixture with an even distribution of fuel and air may combust more completely than a mixture with an uneven distribution of fuel and air. A more complete combustion may result in an increase in the overall performance of the engine in terms of either improved efficiency or reduced emission generation.

One method of improving the mixing characteristics of the fuel and air mixture involves increasing the pressure of the fuel before the fuel is injected to mix with the intake air. When the pressurized fuel is released into the combustion chamber, the pressure of the fuel causes the fuel to disperse into the intake air. This dispersion aids in evenly distributing the fuel within the intake air.

The pressure of the fuel may be increased through any of several different methods. For example, as shown in U.S. Pat. No. 6,102,004 to Cowden et al., a fuel injection system may include a pair of pumps that act to increase the pressure of the fuel. A first pump, or transfer pump, may be adapted to transfer a flow of fuel from a fuel tank through a series of filters to a second pump. The second pump, or high pressure pump, may be adapted to increase the pressure of the flow of fuel to an injection pressure.

The mixing characteristics of the fuel and air mixture may be optimized by maintaining the actual injection pressure of the fuel at or near a desired injection pressure. Any deviations in the actual injection pressure from the desired injection pressure may detract from the mixing characteristics of the air and fuel and, thus, detract from the overall engine performance. Because the high pressure pump typically applies a relatively constant amount of work to the flow of the fuel, the injection pressure at the outlet of the pump will depend, at least in part, upon the pressure of the fuel at the inlet of the high pressure pump.

The pressure of the fuel at the inlet of the high pressure pump may depend on several factors. For example, the pressure of the fuel may depend upon the operation of the first pump, the condition of the filters, and the fuel demands of the engine. A change in any of these factors may cause a change in the pressure of the fuel at the inlet of the high pressure pump and a corresponding change in the overall performance of the engine.

The fuel supply system of the present disclosure solves one or more of the problems set forth above.

SUMMARY OF THE INVENTION

In one aspect, the present disclosure is directed to a fuel supply system. The system includes a first pump adapted to generate a flow of fuel and a second pump in fluid connection with the first pump and adapted to increase the flow of fuel to a predetermined pressure. A fuel filter is disposed between the first pump and the second pump. A sensing line is adapted to provide an indication of the pressure of the flow of fuel between the filter and the second pump. A pressure regulator is adapted to receive the indication of the pressure of the flow of fuel and to control the flow of fuel delivered to the fuel filter based on the indication of the pressure.

In another aspect, the present disclosure is directed to a method of supplying fuel to an internal combustion engine. A flow of fuel is provided with a first pump. The flow of fuel is filtered with a filter disposed in fluid connection with the first pump. The pressure of the flow of fuel is increased to a predetermined pressure with a second pump. The flow of fuel between the first pump and the filter is regulated based on a sensed pressure of the flow of fuel between the filter and the second pump.

DETAILED DESCRIPTION

Figure 1:
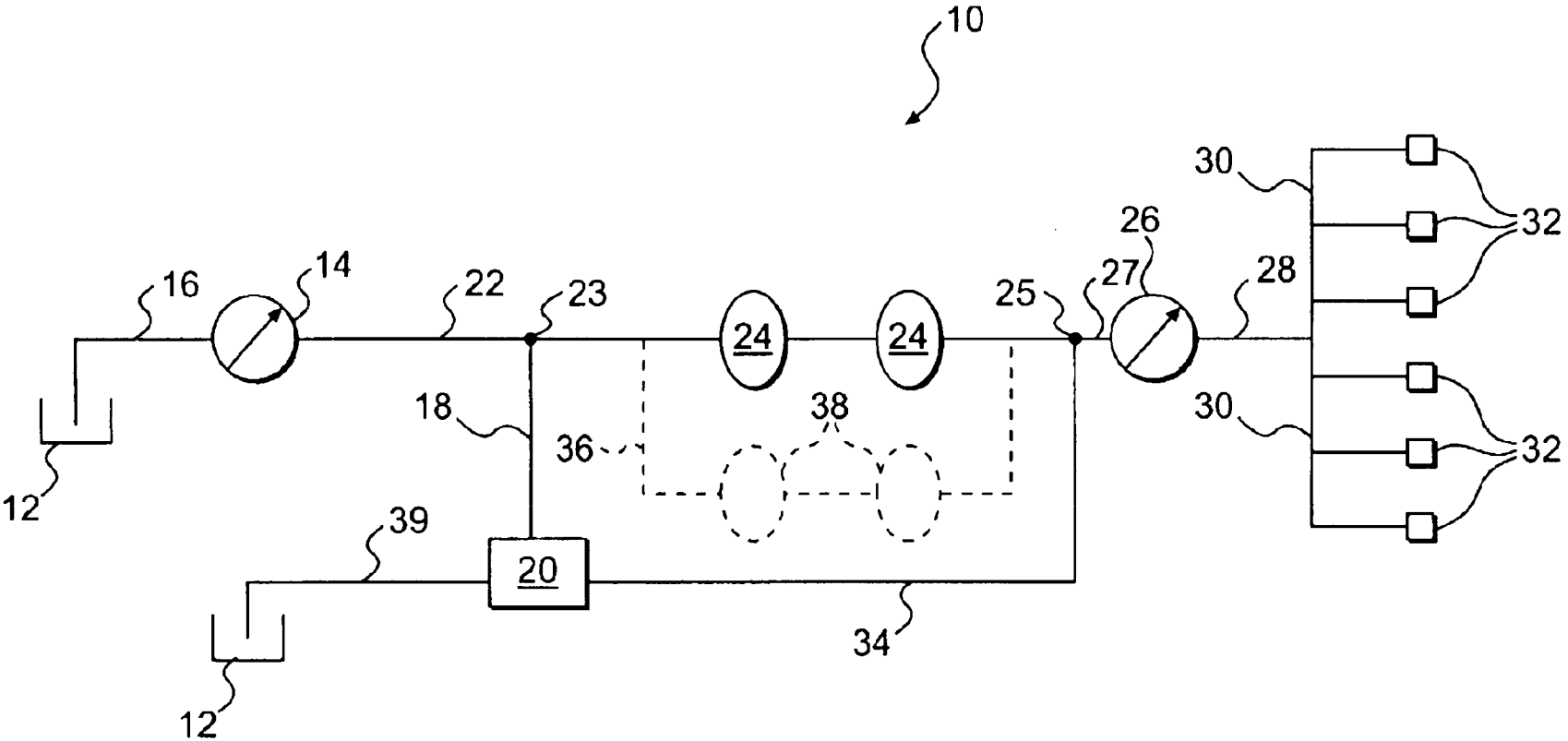
FIG. 1 is a schematic and diagrammatic illustration of a fuel supply system in accordance with an exemplary embodiment of the present invention.

An exemplary embodiment of a fuel supply system 10 is illustrated in FIG. 1. Fuel supply system 10 includes a first pump 14, which may be referred to as a "transfer pump." First pump 14 is adapted to draw a flow of fuel, which may be, for example, gasoline or diesel fuel, from a tank 12 through a fuel line 16. First pump 14 transfers the flow of fuel from tank 12 through a fuel line 22. First pump 14 may be any type of pump commonly used in a fuel supply system, such as, for example, a gear driven transfer pump. One skilled in the art will recognize that first pump 14 may be a constant displacement pump or a variable displacement pump.

One or more filters 24 may be disposed in fuel line 22. First pump 14 directs the flow of fuel from tank 12 through filters 24. Filters 24 may be adapted to remove dirt, debris, or any other undesirable elements from the flow of fuel. Filters 24 may be any type of filter commonly used in a fuel supply system, such as, for example, 2 micron filters.

Filters 24 may be disposed in series within fuel supply system 10. Alternatively, filters 24 may be disposed in parallel within fuel supply system. For example, fuel line 22 may branch into a fuel line 36 to connect a second set of filters 38 in parallel with filters 24.

Fuel supply system 10 may also include a second pump 26. Second pump 26 includes an inlet 27 that is adapted to receive the flow of fuel leaving filters 24. Second pump 26 is adapted to increase the pressure of the flow of fuel at an outlet 28 to a predetermined pressure, which may also be referred to as an "injection pressure." Second pump 26 may be, for example, a fixed capacity pump, a variable capacity pump, or a variable displacement pump. One skilled in the art will recognize that second pump 26 may be any type of pump commonly used in a fuel injection or supply system.

Fuel supply system 10 may also include a fuel rail 30. Fuel rail 30 is connected to outlet 28 of second pump 26 to receive the flow of fuel exiting second pump 26. Fuel rail 30 is adapted to receive and hold a quantity of fuel at the predetermined, or injection, pressure.

A series of fuel injectors 32 may be placed in fluid connection with the fuel rail 30. Each fuel injector 32 may be associated with a combustion chamber (not shown) of an internal combustion engine. Each fuel injector 32 may be adapted to inject a certain quantity of fuel into the respective combustion chamber at a certain point in the operating cycle of the engine. Fuel injectors 32 may be controlled mechanically, electronically, hydraulically, or any combination thereof.

Fuel supply system 10 may also include a pressure regulator 20 to control the pressure of the fuel at inlet 27 to second pump 26. Pressure regulator 20 may be adapted to control the flow of fuel between first pump 14 and filters 24 based on the pressure of the fuel at inlet 27 to second pump 26. Pressure regulator 20 may reduce the amount of fuel flowing to filters 24 when the pressure of the fuel at inlet 27 to second pump 26 increases above a certain level and may increase the amount of fuel flowing to filters 24 when the pressure of the fuel at inlet 27 decreases below a certain level.

Pressure regulator 20 may be connected to fuel line 22 at a first location 23 disposed between the outlet of first pump 14 and filters 24 and at a second location 25 disposed between filters 24 and inlet 27 to second pump 26. A first fuel line 18 may provide a connection between first location 23 and pressure regulator 20. A second fuel line 34 may provide a connection between second location 25 and pressure regulator 20. A third fuel line 39 may connect pressure regulator 20 with tank 12.

Figure 2:
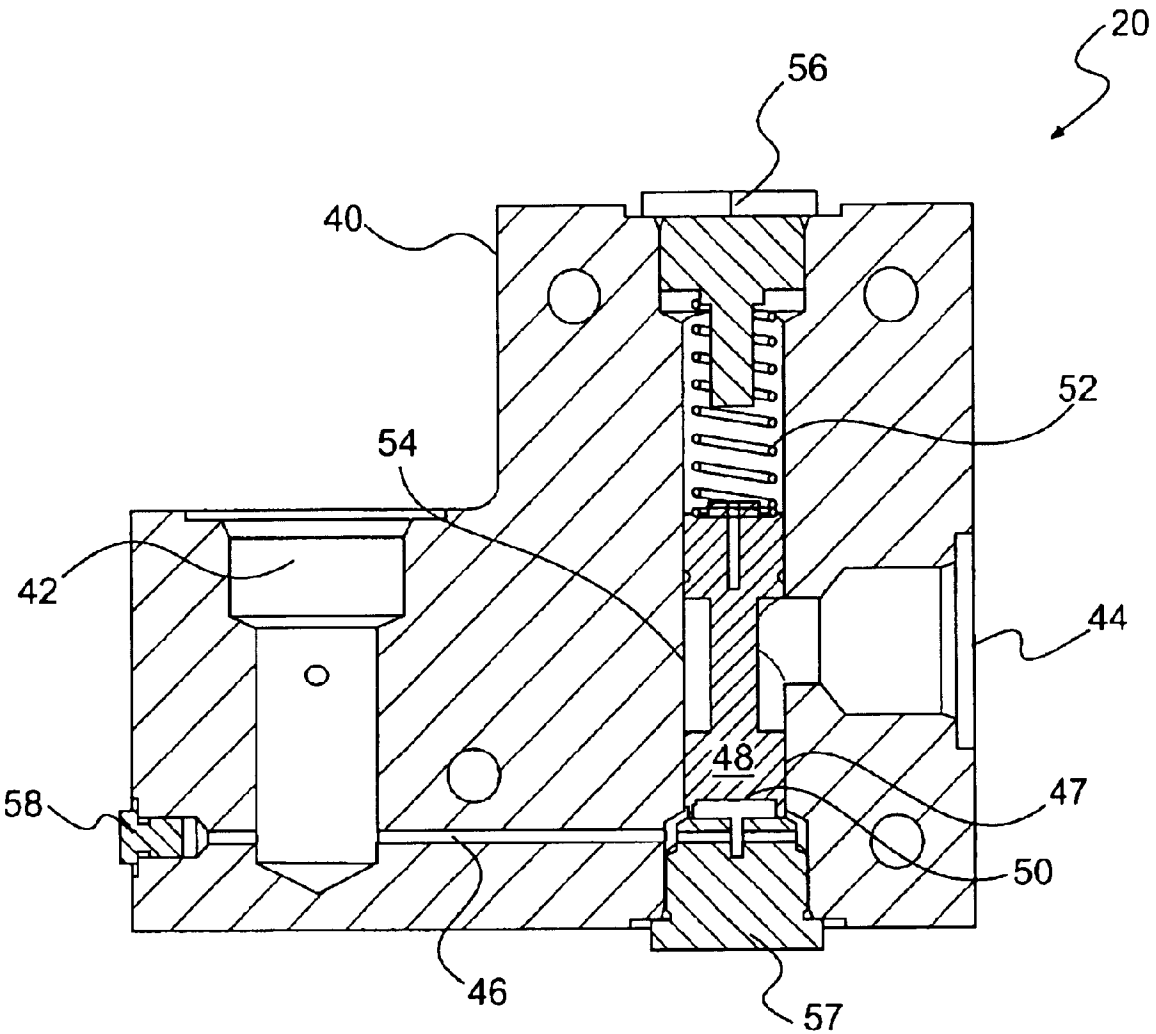
FIG. 2 is a sectional view of a pressure regulator in accordance with an exemplary embodiment of the present invention.

As shown in FIG. 2, pressure regulator 20 may include a housing 40. Housing 40 may define a sensing port 42 that is adapted to be connected to second fuel line 34. A flow of fuel having a pressure representative of the pressure of the fuel in fuel line 22 at inlet 27 to second pump 26, such as, for example, at second location 25, may flow through second fuel line 34 and sensing port 42 and into housing 40.

The flow of fuel through second fuel line 34 provides pressure regulator 20 with an indication of the pressure of the fuel at inlet 27 to second pump 26. One skilled in the art will recognize that the pressure at inlet 27 to second pump 26 may be measured and communicated to pressure regulator 20 in other methods. For example, a pressure sensor may be disposed at second location 25 and adapted to transmit an electronic representation of the fuel pressure at inlet 27 to second pump 26 to pressure regulator 20.

Housing 40 may also define an inlet port 44. Inlet port 44 is adapted to be connected to first fuel line 18 (referring to FIG. 1). First fuel line 18 provides a fluid connection between fuel line 22 at first location 23 and pressure regulator 20 through inlet port 44.

Figure 3:
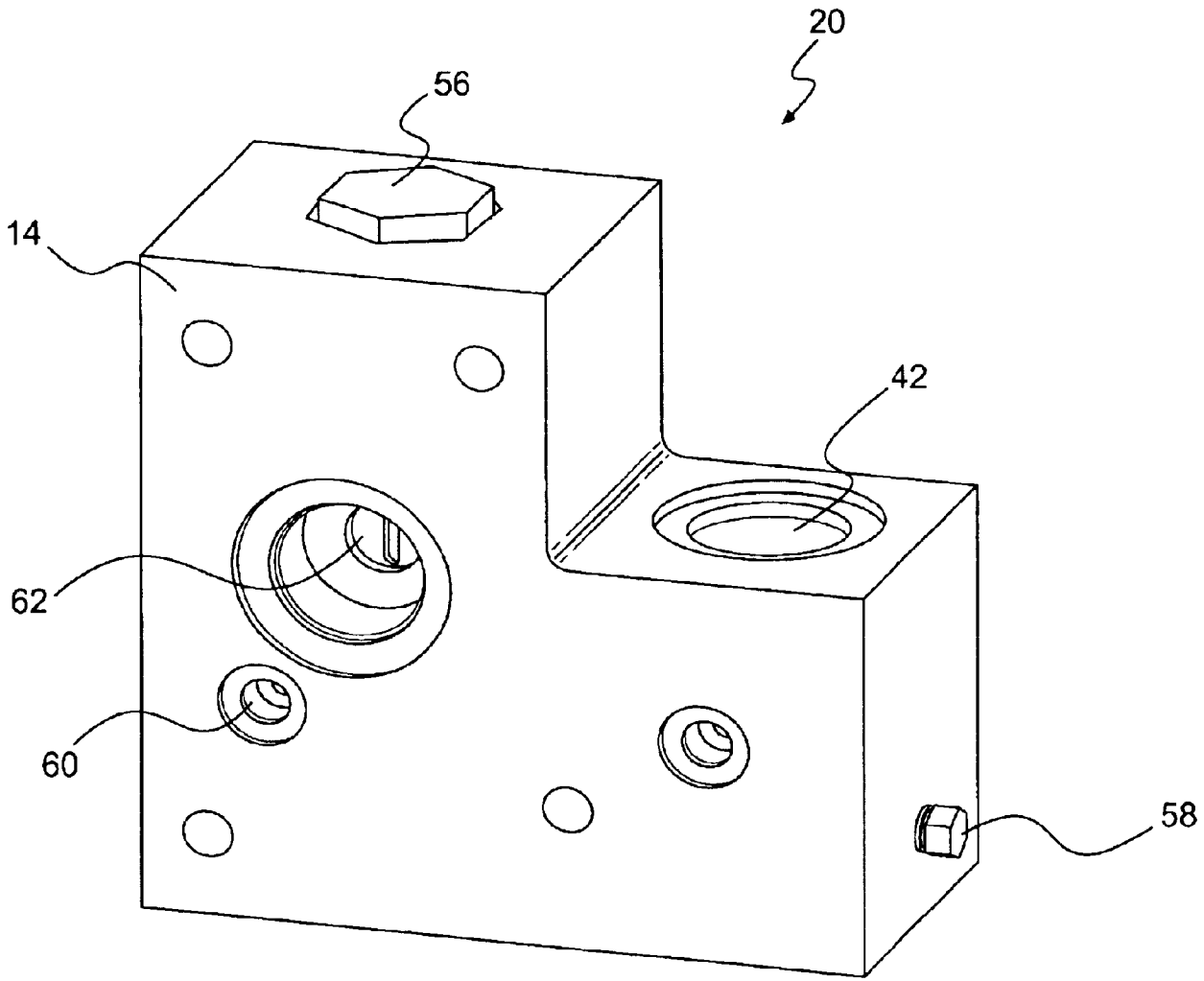
FIG. 3 is a pictorial view of a pressure regulator in accordance with an exemplary embodiment of the present invention.

As shown in FIG. 3, housing 40 may further define an outlet port 62. Outlet port 62 may be adapted for connection with third fuel line 39 (referring to FIG. 1). Third fuel line 39 provides a fluid connection between pressure regulator 20 and tank 12.

As shown in FIG. 2, pressure regulator 20 includes a spool valve 48 having a spool valve outlet 54 and a piston end 50. Housing 40 includes an opening 47 adapted to receive spool valve 48. Housing 40 includes fluid passageways adapted to place spool valve 48 in fluid connection between inlet port 44 and outlet port 62. Spool valve 48 is moveable between a first position, where fuel is prevented from flowing from inlet port 44 to outlet port 62 and a second position, where spool valve outlet 54 is positioned to allow fuel to flow from inlet port 44 to outlet port 62.

A spring stop 56 may be engaged with one end of opening 47 in housing 40. A spring 52 may be disposed between spring stop 56 and spool valve 48. Spring 52 may act to bias spool valve 48 towards the first position. A spool stop 57 may be engaged with the other end of opening 47 in housing 40. Spool stop 57 may define the first position.

Housing 40 may include a sensing line 46 that provides a fluid connection between sensing port 42 and piston end 50 of spool valve 48. Fuel at a pressure that is representative of the fuel pressure at inlet 27 of second pump 26 may flow through sensing line 46 to act on spool valve 48. When the force exerted by the fuel on piston end 50 is greater than the force of spring 52, spool valve 48 will move towards the second position. As spool valve 48 moves towards the second position, spool valve outlet 54 will align with outlet port 62 to allow fuel to flow from inlet port 44 through outlet port 62 to tank 12.

Housing 40 may include one or more openings. For example, sensing line 46 may be formed by drilling a hole in housing 40. A plug 58 may be disposed in the resulting opening in housing 40 to prevent fuel from escaping through the hole. In addition, housing 40 may include a bore 60. A pressure sensor (not shown) may be disposed in bore 60 to sense the pressure of the fuel at inlet port 44.

While the foregoing disclosure describes the operation of a hydraulically controlled pressure regulator, one skilled in the art will recognize that pressure regulator 20 may operate in other methods. For example, the pressure of the fuel at inlet 27 may be sensed and transmitted electronically to a control (not shown). Based on the sensed pressure, the control may govern the position of spool valve 48, such as, for example, through a solenoid, to control the amount of fluid flowing through pressure regulator 20 to tank 12.

Figure 4:
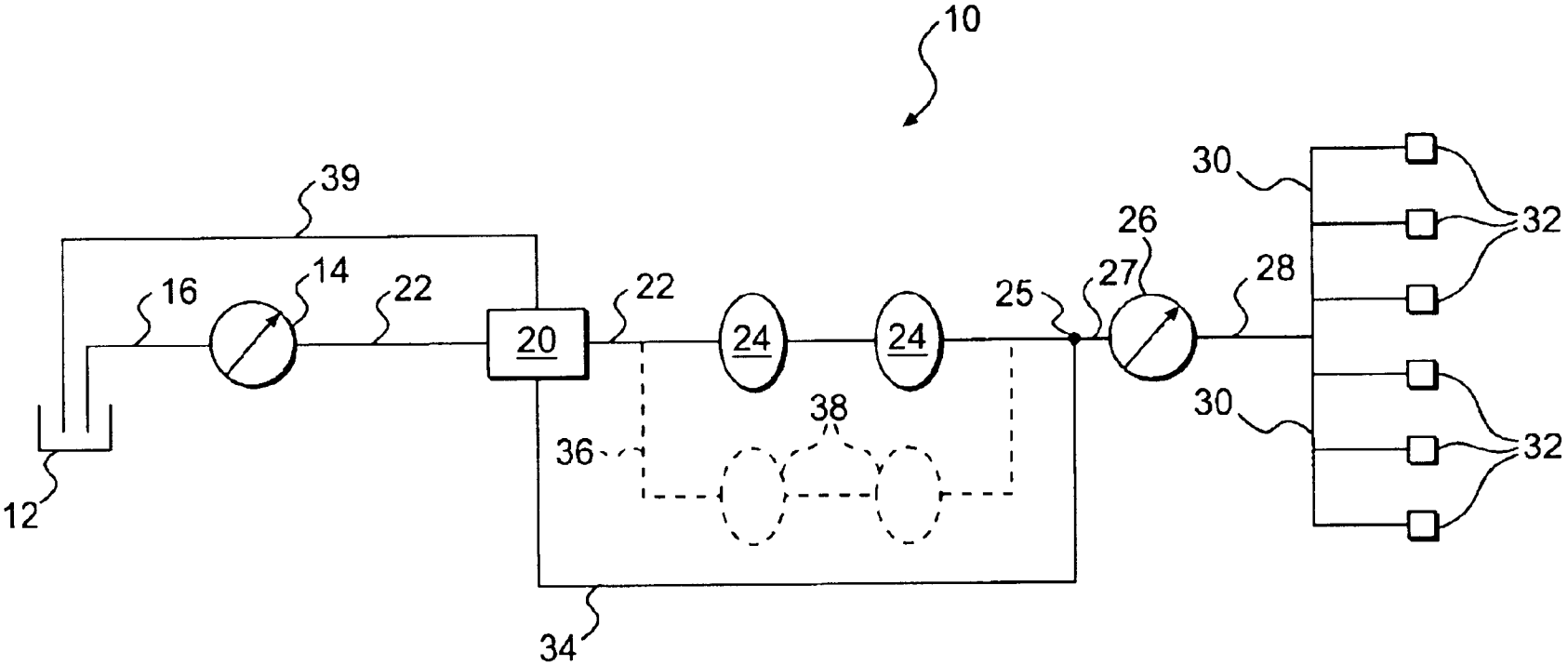
FIG. 4 is a schematic and diagrammatic illustration of a fuel supply system in accordance with another exemplary embodiment of the present invention.

An alternative embodiment of fuel supply system 10 is shown in FIG. 4, where pressure regulator 20 is configured as a "flow through" device. As shown, pressure regulator 20 is disposed in fuel line 22 so that the entire flow of fuel from first pump 14 flows through pressure regulator 20 to filters 24. Pressure regulator 20 receives an indication of the pressure of the fuel at inlet 27 to second pump 26 through fuel line 34.

Pressure regulator 20 controls the flow of fuel to filters 24 based on the pressure indication through fuel line 34. For example, pressure regulator 20 may include a bleed valve (not shown), or other type of control valve, that may be opened when the pressure of the fuel at inlet 27 to second pump 26 exceeds a certain limit. The position of the bleed valve may be controlled hydraulically or electronically. When the bleed valve opens, fuel is allowed to flow through third fuel line 39 to tank 12 to thereby decrease the amount of fuel flowing through filters 24.

Industrial Applicability

Pressure regulator 20 is adapted to control the pressure of the fuel at inlet 27 to second pump 26. When fuel supply system 10 is operating, first pump 14 draws fuel from tank 12 and transfers a flow of fuel through filters 24 to second pump 26. Second pump 26 applies work to the fuel to further increase the flow of fuel to an injection pressure. The pressurized fuel is then directed into fuel rail 30. Fuel injectors 32 inject the pressurized fuel into the combustion chambers (not shown) of the engine.

Pressure regulator 20 controls the amount of fuel flowing from first pump 14 to filters 24 based on the pressure of the fuel at inlet 27 of second pump 26. By increasing the amount of fuel flowing through filters 24, the pressure of the fuel at inlet 27 of second pump 26 may be increased. By decreasing the amount of fuel flowing through filters 24, the pressure of the fuel at inlet 27 of second pump 26 may be decreased.

An indication of the pressure of the fuel at inlet 27 of second pump 26 is transmitted to pressure regulator 20 through a flow of fuel in second fuel line 34. The fuel is directed through housing 40 to act against piston end 50 of spool valve 48. When the force of the fuel on spool valve 48 exceeds the force of spring 52, spool valve 48 will move towards the second position to thereby allow a flow of fuel to flow from first fuel line 18 through third fuel line 39 to tank 12. This release of fuel will decrease the amount of fuel flowing through filters 24 to second pump 26 and will thereby reduce the pressure of the fuel at inlet 27 to second pump 26.

When the pressure of the fuel at inlet 27 decreases, the force acting on spool valve 48 will similarly decrease. When the force of spring 52 on spool valve 48 exceeds the force exerted by the fuel on piston end 50 of spool valve 48, spring 52 will move spool valve towards the first position to reduce the amount of fuel flowing to tank 12. This, in turn, will increase the pressure of the fuel at inlet 27 to second pump 26.

In this manner, pressure regulator 20 may control the pressure of the fuel at inlet 27 to second pump 26 to be within a predetermined range. Maintaining the fuel at inlet 27 to second pump 26 within the predetermined range allows second pump 26 to operate properly. Accordingly, the fuel in fuel rail 30 may have a substantially constant pressure. Thus, fuel supply system 10 may be operated to supply a flow of fuel to fuel rail 30 that has an injection pressure adapted to optimize the mixing characteristics of the fuel and air.

As will be apparent from the foregoing description, the present disclosure provides a fuel supply system 10 that controls the flow rate of fuel from a transfer pump 14 to a high pressure pump 26. By controlling the flow of fuel to the high pressure pump 26, the pressure of the fuel at the outlet 28 of the high pressure pump 26 may be maintained at or near a desired injection pressure. This leads to an improvement in the combustion characteristics of the fuel and air mixture and to an improvement in the overall performance of the internal combustion engine in terms of engine efficiency and/or emission generation.

As one skilled in the art will recognize, a fuel supply system 10 in accordance with the present disclosure may be used with any type of internal combustion engine. For example, fuel supply system 10 may be used with a gasoline or diesel engine. In addition, the internal combustion engine may be used in any common application, such as, for example, to power a vehicle or to drive a generator.

It will be apparent to those skilled in the art that various modifications and variations can be made in the fuel supply system of the present invention without departing from the scope of the disclosure. Other embodiments of the fuel supply system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A fuel supply system, comprising:

a first pump adapted to generate a flow of fuel;

a second pump in fluid connection with the first pump and adapted to increase the flow of fuel to a predetermined pressure;

a fuel filter disposed between the first pump and the second pump;

a sensing line adapted to provide an indication of the pressure of the flow of fuel between the filter and the second pump;

a tank;

a drain line disposed between the first pump and the fuel filter, the drain line configured to direct at least of portion of the fuel flow from the first pump to the tank; and a pressure regulator disposed in the drain line and adapted to receive the indication of the pressure of the flow of fuel and to control the flow of fuel delivered to the fuel filter based on the indication of the pressure.

2. The system of claim 1, wherein the first pump is a gear driven pump.

3. The system of claim 1, wherein the indication of the pressure is provided through a flow of fuel.

4. The system of claim 3, wherein the pressure regulator includes a spool valve adapted to open and allow fuel to flow to a tank when the indication of the pressure is above a predetermined limit.

5. The system of claim 1, wherein a portion of the flow of the fuel is directed through the pressure regulator.

6. The system of claim 1, further including a plurality of filters configured to receive a flow of fluid from the first pump.

7. The system of claim 6, wherein the plurality of filters are disposed in parallel between the first pump and the second pump.

8. A method of supplying fuel to an internal combustion engine, comprising:

providing a flow of fuel with a first pump;

filtering the flow of fuel with a filter disposed in fluid connection with the first pump;

increasing the pressure of the flow of fuel to a predetermined pressure with a second pump;

receiving an indication of the pressure of the flow of fuel between the filter and the second pump; and selectively directing at least a portion of the flow of fuel from between the first pump and the filter to a tank in response to the indication of the pressure of the flow of fuel.

9. The method of claim 8, further including sensing the pressure of the flew of fuel between the filter and the second pump.

10. The method of claim 9, wherein the indication of the pressure of the flow of fuel corresponds to the sensed pressure.

11. The method of claim 8, further including adjusting a position of a spool valve based on the indication of the pressure of the flow of fuel.

12. A fuel supply system, comprising:

a first pump adapted to generate a flow of fuel;

a second pump in fluid connection with the first pump and adapted to increase the flow of fuel to a predetermined pressure;

a fuel filter disposed between the first pump and the second pump;

a means for sensing the pressure of the flow of fuel between the filter and the second pump;

a tank;

a drain line disposed between the first pump and the fuel filter, the drain line configured to direct at least of portion of the flow of fuel from the first pump to the tank; and a means for controlling the at least a portion of the flow of fuel based on the sensed pressure of the flow of fuel between the filter and the second pump.

13. A fuel injection system, comprising:

a first pump adapted to generate a flow of fuel;

a second pump in fluid connection with the first pump and adapted to increase the flow of fuel to a predetermined pressure;

a fuel filter disposed between the first pump and the second pump;

a sensing line adapted to provide an indication of the pressure of the flow of fuel between the filter and the second pump;

a tank;

a drain line disposed between the first pump and the fuel filter, the drain line configured to direct at least of portion of the fuel flow from the first pump to the tank;

a pressure regulator disposed in the drain line and adapted to receive an indication of the pressure of the flow of fuel and to control the flow of fuel delivered to the fuel filter based on the indication of the pressure received;

a fuel rail adapted to receive the flow of fuel from the second pump at the predetermine pressure; and a fuel injector in fluid connection with the fuel rail.

14. The system of claim 13 wherein the indication of the pressure is provided through a flow of fuel.

15. The system of claim 13, wherein substantially all of the flow of fuel is directed through the pressure regulator.

16. The system of claim 13, wherein a portion of the flow of the fuel is directed through the pressure regulator.

17. The system of claim 13, further including a plurality of filters in fluid connection with the first pump.

18. The system of claim 17, wherein the plurality of filters are disposed in series between the first pump and the second pump.

19. The system of claim 13, wherein the pressure regulator includes a spool valve adapted to open and allow fuel to flow to a tank when the indication of the pressure is above a predetermined limit.

* * * * *